US010928751B2

(12) United States Patent
Akiba et al.

(10) Patent No.: US 10,928,751 B2
(45) Date of Patent: Feb. 23, 2021

(54) REMANUFACTURING METHOD FOR DEVELOPING APPARATUS AND CARTRIDGE

(71) Applicant: CANON KABUSHIKI KAISHA, Tokyo (JP)

(72) Inventors: Yu Akiba, Susono (JP); Toshiaki Takeuchi, Susono (JP); Koichi Ooishi, Mishima (JP); Naoya Asanuma, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/551,917

(22) Filed: Aug. 27, 2019

(65) Prior Publication Data

US 2020/0073287 A1 Mar. 5, 2020

(30) Foreign Application Priority Data

Aug. 29, 2018 (JP) ..... JP2018-160408
Aug. 2, 2019 (JP) ..... JP2019-142871

(51) Int. Cl.

| | |
|---|---|
| ***G03G 15/00*** | (2006.01) |
| ***G03G 15/08*** | (2006.01) |
| ***G03G 21/18*** | (2006.01) |
| ***G03G 21/16*** | (2006.01) |

(52) U.S. Cl.

CPC ..... *G03G 15/0894* (2013.01); *G03G 15/0865* (2013.01); *G03G 15/0889* (2013.01); *G03G 21/1647* (2013.01); *G03G 21/181* (2013.01); *G03G 2215/00991* (2013.01)

(58) Field of Classification Search

CPC ..... G03G 15/0894; G03G 15/0889; G03G 15/0865; G03G 21/181; G03G 21/1647; G03G 2215/00991

See application file for complete search history.

(56) References Cited

U.S. PATENT DOCUMENTS

| | | | |
|---|---|---|---|
| 6,856,775 | B2 | 2/2005 | Sekine |
| 8,121,517 | B2 | 2/2012 | Asanuma et al. |
| 8,139,972 | B2 | 3/2012 | Abe et al. |
| 8,270,876 | B2 | 9/2012 | Morioka et al. |
| 8,369,744 | B2 | 2/2013 | Asanuma et al. |
| 8,688,004 | B2 | 4/2014 | Asanuma et al. |

(Continued)

FOREIGN PATENT DOCUMENTS

| | | |
|---|---|---|
| EP | 3 316 042 A1 | 5/2018 |
| JP | 2002-251119 A | 9/2002 |

(Continued)

OTHER PUBLICATIONS

Copending U.S. Appl. No. 16/546,768, filed Aug. 21, 2019.

(Continued)

*Primary Examiner* — Hoang X Ngo
(74) *Attorney, Agent, or Firm* — Venable LLP

(57) ABSTRACT

A remanufacturing method of a developing apparatus including: a communicating step of removing a part of a frame of the developing apparatus to form a communication hole such that an outside of the frame and a developing chamber of the frame are connected each other; a refilling step of refilling an inside of the frame with developer via the communication hole; and a sealing step of sealing the communication hole.

24 Claims, 13 Drawing Sheets

(56) References Cited

U.S. PATENT DOCUMENTS

| | | | | |
|---|---|---|---|---|
| 9,052,638 | B2 | 6/2015 | Matsumaru et al. | |
| 9,069,289 | B2 | 6/2015 | Batori et al. | |
| 9,116,466 | B2 | 8/2015 | Makiguchi et al. | |
| 9,164,424 | B2 | 10/2015 | Nakamura et al. | |
| 9,164,430 | B2 | 10/2015 | Murakami et al. | |
| 9,188,906 | B2 | 11/2015 | Batori et al. | |
| 9,229,371 | B2 | 1/2016 | Murakami et al. | |
| 9,354,552 | B2 | 5/2016 | Takeuchi | |
| 9,465,318 | B2 | 10/2016 | Takeuchi et al. | |
| 9,494,890 | B2 | 11/2016 | Komatsu et al. | |
| 9,523,942 | B2 | 12/2016 | Takeuchi et al. | |
| 9,599,932 | B2 | 3/2017 | Takeuchi et al. | |
| 9,857,730 | B2 | 1/2018 | Kato et al. | |
| 9,989,892 | B2 | 6/2018 | Takeuchi et al. | |
| 10,037,000 | B2 | 7/2018 | Torii et al. | |
| 10,095,161 | B2 | 10/2018 | Takeuchi et al. | |
| 10,228,635 | B2 | 3/2019 | Kato et al. | |
| 10,268,156 | B2 | 4/2019 | Takeuchi et al. | |
| 10,474,096 | B2 | 11/2019 | Hirayama et al. | |
| 2005/0232654 | A1 | 10/2005 | Karakama et al. | |
| 2009/0297208 | A1 | 12/2009 | Suzuki et al. | |
| 2012/0269540 | A1* | 10/2012 | Kawai | G03G 21/181 399/109 |
| 2014/0112686 | A1 | 4/2014 | Asanuma et al. | |
| 2016/0124347 | A1 | 5/2016 | Isobe et al. | |
| 2017/0329279 | A1 | 11/2017 | Hirayama et al. | |
| 2018/0143569 | A1* | 5/2018 | Isobe | G03G 15/0894 |
| 2019/0179256 | A1 | 6/2019 | Hirayama et al. | |
| 2019/0204779 | A1 | 7/2019 | Takeuchi et al. | |

FOREIGN PATENT DOCUMENTS

| | | | |
|---|---|---|---|
| JP | 2002-278423 | A | 9/2002 |
| JP | 2002-328588 | A | 11/2002 |
| JP | 2005-326832 | A | 11/2005 |
| JP | 2009-288286 | A | 12/2009 |
| JP | 2016-085372 | A | 5/2016 |

OTHER PUBLICATIONS

Copending U.S. Appl. No. 16/551,925, filed Aug. 27, 2019.
Copending U.S. Appl. No. 16/659,839, filed Oct. 22, 2019.
Apr. 3, 2020 Extended Search Report in European Patent Application No. 19 193 712.7.
Japanese Patent Application Pub. No. 2002-278423 A1.
United States Patent Application Pub. No. 2018/0143569 A1.
European Patent Application Pub. No. 3 316 042 A1.

* cited by examiner

REMANUFACTURING METHOD FOR DEVELOPING APPARATUS AND CARTRIDGE

BACKGROUND OF THE INVENTION

Field of the Invention

The present invention relates to a developer storage container provided in an image forming apparatus such as a copier or a printer and to remanufacturing of a cartridge such as a developing apparatus or a process cartridge provided with the developer storage container.

Description of the Related Art

Among image forming apparatuses using an electrophotographic image formation system (an electrophotographic process), image forming apparatuses with superior usability in which various process means are integrated as a cartridge configured so as to be attachable to and detachable from an image forming apparatus main body are being put to practical use for the purpose of facilitating maintenance. With such a cartridge system image forming apparatus, an image is formed on a recording material (a recording medium) using toner stored in a cartridge (a developing apparatus formed as a cartridge or a process cartridge). The toner stored in the cartridge is consumed as image formation is performed, and once the toner is consumed to such an extent that images of high enough quality to satisfy a user having purchased the cartridge can no longer be formed, the cartridge loses its commercial value.

In recent years, cartridges having lost their commercial values once their toner has been consumed are being remanufactured (recycled). As such a remanufacturing method, for example, a method has been proposed which involves boring a hole at one end in a longitudinal direction of a developer storage chamber in a cartridge, refilling the developer storage chamber with toner from the bored hole, and sealing the hole with a sealing member once the refill is completed (Japanese Patent Application Laid-open No. 2002-328588). In addition, as a remanufacturing method of a cartridge, a method has also been proposed which involves boring a hole on a surface parallel to a photosensitive member axis of a developer storage chamber in a cartridge, refilling the developer storage chamber with toner from the bored hole, and sealing the hole with a sealing member once the refill is completed (Japanese Patent Application Laid-open No. 2002-251119).

The cartridges described above include those that have a stiffing member for stirring toner inside a developer storage chamber. With such cartridges, the stirring member arranged inside the developer storage chamber may sometimes interfere with the remanufacturing process described above.

An object of the present invention is to provide a remanufacturing method of a cartridge which prevents work from being disturbed by a stirring member of the cartridge.

SUMMARY OF THE INVENTION

In order to achieve the object described above, the remanufacturing method according to the present invention is a remanufacturing method for remanufacturing a developing apparatus, the developing apparatus including:

a frame having a storage chamber for storing a developer, a developing chamber in which a developer bearing member for bearing the developer is to be arranged, and a partition portion that partitions the storage chamber and the developing chamber, the frame being provided with an opening in the partition portion such that the storage chamber and the developing chamber are connected each other; and a stirring member for stirring the developer, the stirring member being arranged in the storage chamber so as to be capable of coming into contact with a wall surface of the frame that forms the storage chamber, the remanufacturing method comprising:

a communicating step of removing a part of the frame to form a communication hole such that an outside of the frame and the developing chamber are connected each other;

a refilling step of refilling an inside of the frame with the developer via the communication hole; and a sealing step of sealing the communication hole.

In addition, in order to achieve the object described above, the remanufacturing method according to the present invention is a remanufacturing method for remanufacturing a developing apparatus, the developing apparatus including:

a frame having a storage chamber for storing a developer, a developing chamber in which a developer bearing member for bearing the developer is to be arranged, and a partition portion that partitions the storage chamber and the developing chamber, the frame being provided with an opening in the partition portion such that the storage chamber and the developing chamber with each other; and a stirring member for stirring the developer, the stirring member being arranged in the storage chamber so as to be capable of coming into contact with a wall surface of the frame that forms the storage chamber, the frame being provided with a ventilation opening which connects an outside of the frame and the developing chamber each other, and a filter which is attached to the frame so as to cover the ventilation opening, the remanufacturing method comprising:

a communicating step of forming a communication hole which connects the outside of the frame and the developing chamber each other by peeling away at least a part of the filter from the frame;

a refilling step of refilling an inside of the frame with the developer; and a sealing step of sealing the communication hole.

Furthermore, in order to achieve the object described above, the cartridge according to the present invention is a cartridge that is attachable to and detachable from an image forming apparatus, the cartridge including:

a developing apparatus remanufactured by the remanufacturing method according to the present invention; and a restricting member for restricting the developer borne by the developer bearing member.

Further features of the present invention will become apparent from the following description of exemplary embodiments (with reference to the attached drawings).

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

First Embodiment

Figure 2:
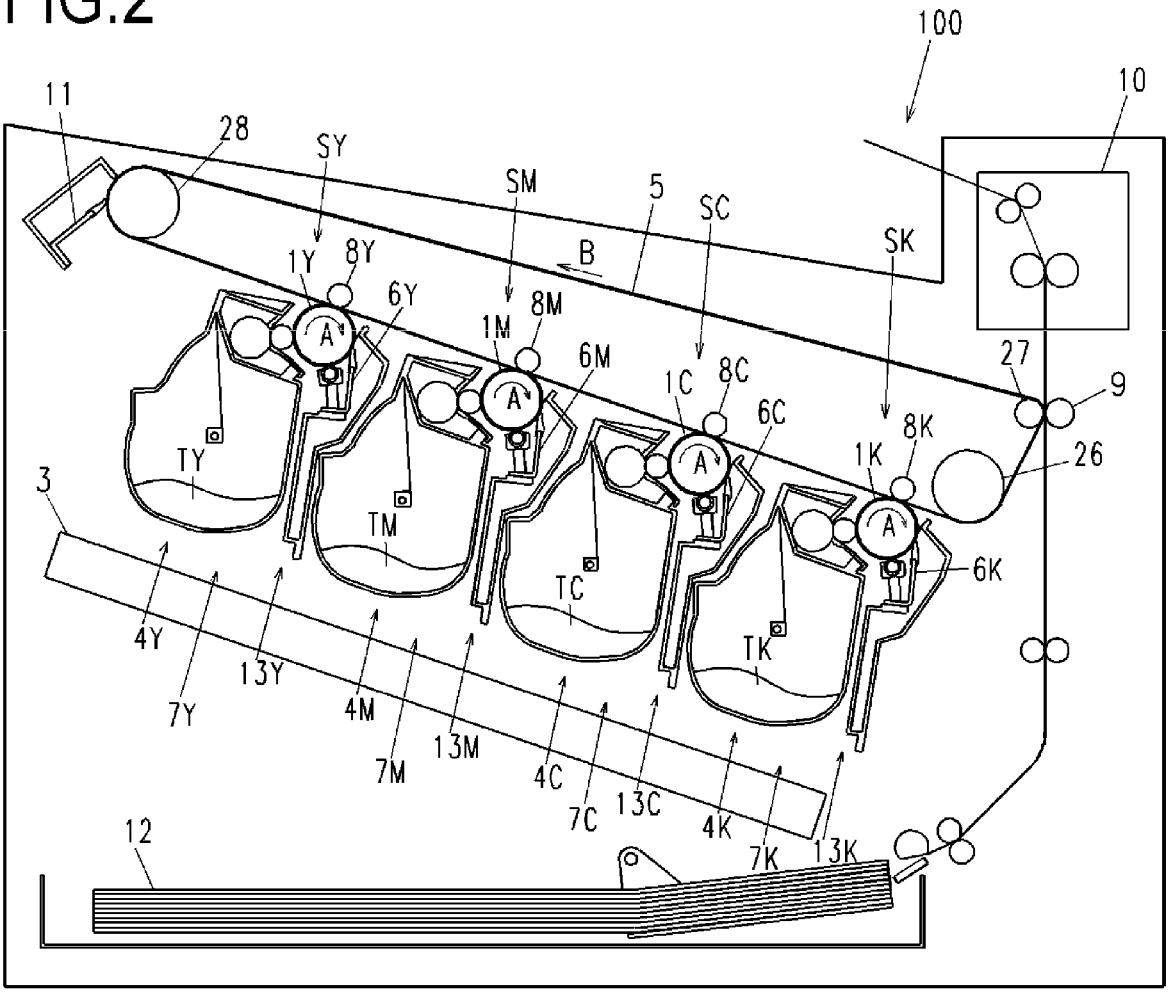
FIG. 2 is a sectional view of an electrophotographic image forming apparatus according to the first embodiment.
Figure 3:
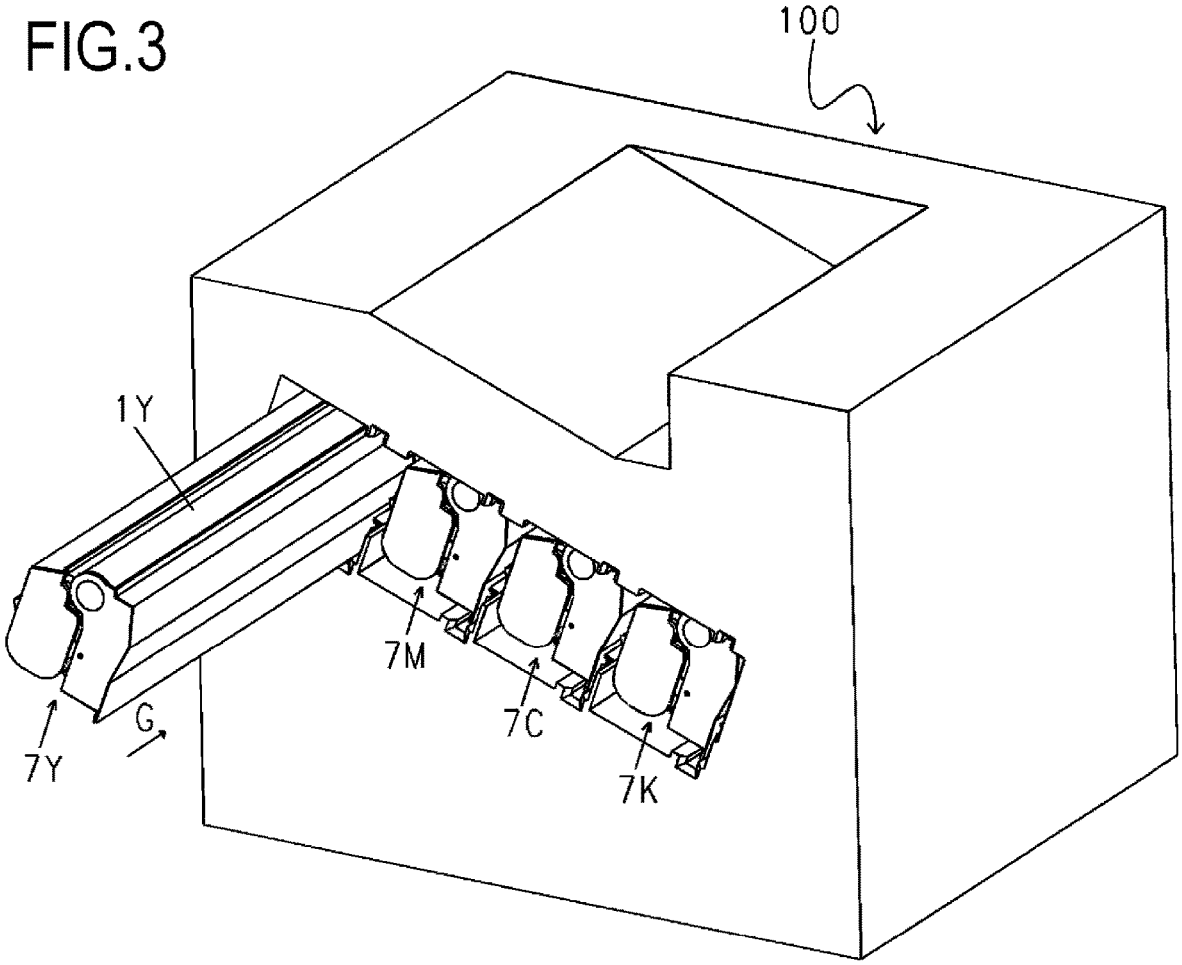
FIG. 3 is a perspective view of a process cartridge according to the first embodiment when mounting the process cartridge to an apparatus main body.
Figure 4:
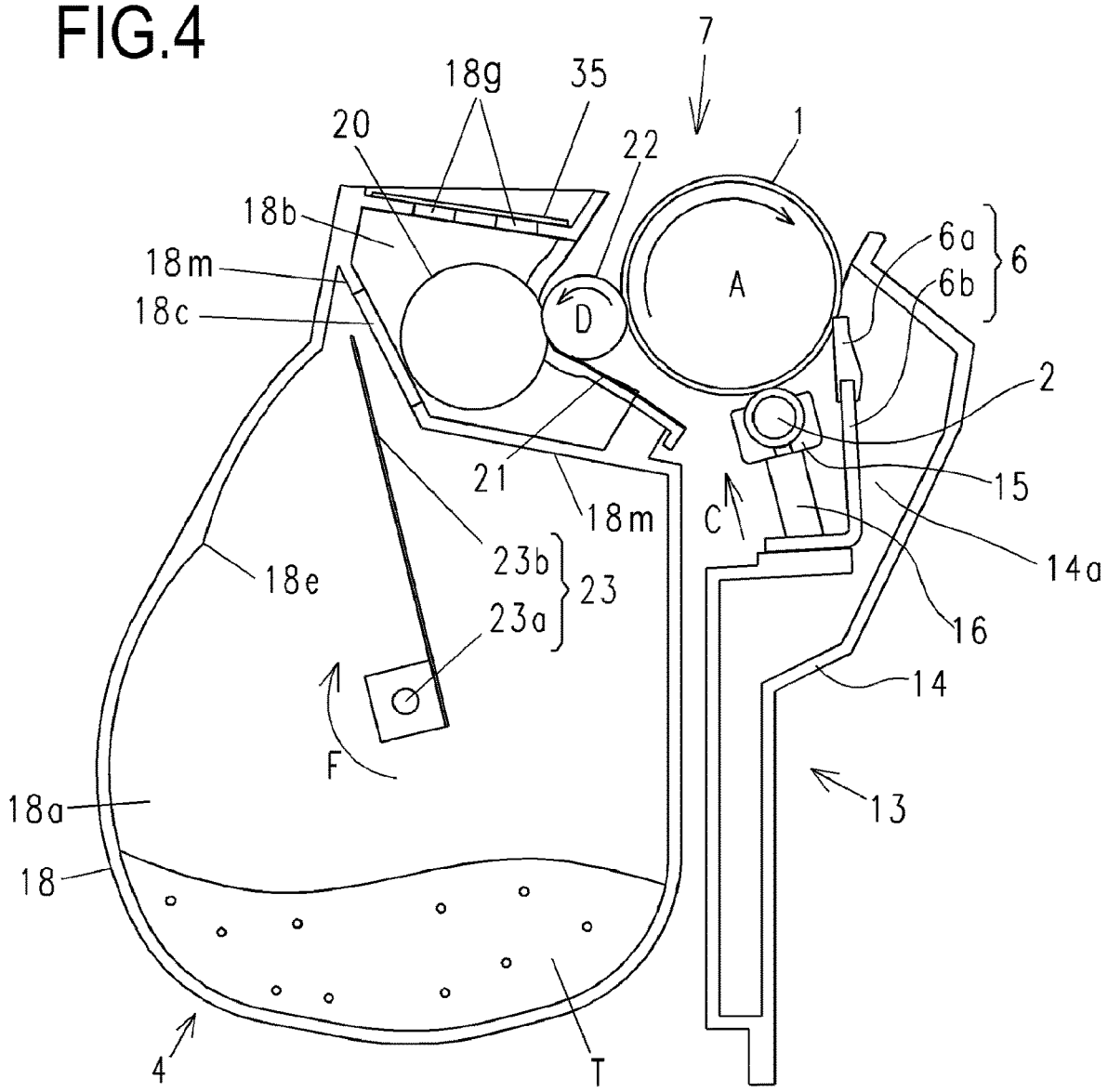
FIG. 4 is a sectional view of the process cartridge according to the first embodiment.

Configurations of a process cartridge 7 and an image forming apparatus 100 according to an embodiment of the present invention will be described with reference to FIGS. 2 to 4. FIG. 2 is a schematic sectional view of the image forming apparatus 100 according to the present embodiment. FIG. 3 is a schematic perspective view showing a situation where the process cartridge 7 is mounted to an image forming apparatus main body, in which illustration of components such as a cover that closes a storage portion of the process cartridge 7 in the apparatus main body is omitted. FIG. 4 is a schematic sectional view of the process cartridge 7 according to the present embodiment.

Electrophotographic Image Forming Apparatus

First, an overall configuration of an electrophotographic image forming apparatus (hereinafter, referred to as an "image forming apparatus") according to the present embodiment will be described with reference to FIGS. 2, 3, and 4. As a plurality of image forming portions, the image forming apparatus 100 includes first, second, third, and fourth image forming portions SY, SM, SC, and SK for respectively forming images of the colors yellow (Y), magenta (M), cyan (C), and black (K). In the present embodiment, configurations and operations of the first to fourth image forming portions are substantially the same with the exception of differences in colors of formed images. Therefore, unless a specific distinction must be made, Y, M, C, and K will be omitted and the image forming portions will be collectively described.

The image forming apparatus 100 according to the present embodiment includes four electrophotographic photosensitive drums (hereinafter, referred to as "photosensitive drums") 1 (1Y, 1M, 1C, and 1K) as four image bearing members. The photosensitive drum 1 rotates in a direction of an arrow A in the drawings. A charging roller 2 and a scanner unit 3 are arranged around the photosensitive drum 1. In this case, the charging roller 2 is charging means which uniformly charges a surface of the photosensitive drums 1. In addition, the scanner unit 3 is exposing means which irradiates a laser based on image information and forms an electrostatic image on the photosensitive drums 1. Developing apparatuses (hereinafter, referred to as "developing units") 4 (4Y, 4M, 4C, and 4K) and cleaning blades 6 (6Y, 6M, 6C, and 6K) as cleaning means are arranged in a periphery of the photosensitive drums 1. Furthermore, an intermediate transfer belt 5 as an intermediate transfer member for transferring a toner image on the photosensitive drums 1 to a recording material 12 is arranged so as to oppose the four photosensitive drums 1.

In the present embodiment, the developing units 4 use toners T (TY, TM, TC, and TK) which are non-magnetic single component developers as developers. In the present embodiment, the developing units 4 perform contact development by bringing a developer bearing member (hereinafter, referred to as a "developing roller") 22 as developing means into contact with the photosensitive drums 1.

In the present embodiment, photosensitive units 13 (13Y, 13M, 13C, and 13K) are formed by the photosensitive drums 1, the charging roller 2, the cleaning blades 6, and a waste toner storage portion 14*a* for storing primary transfer residual toner that remains on the photosensitive drum 1.

Furthermore, in the present embodiment, the process cartridges 7 (7Y, 7M, 7C, and 7K) are formed by integrating the developing unit 4 and the photosensitive unit 13 into a cartridge. The process cartridges 7 are configured so as to be attachable to and detachable from the image forming apparatus 100 via mounting means such as a mounting guide or a positioning member (not shown) provided on the image forming apparatus 100. In the present embodiment, the process cartridges 7 are attachable to and detachable from the image forming apparatus 100 in an axial direction of the photosensitive drums 1 as indicated by an arrow G in FIG. 3.

In the present embodiment, the process cartridges 7 for the respective colors all have the same shape. The process cartridges 7 for the respective colors store toners T (TY, TM, TC, and TK) of the respective colors of yellow (Y), magenta (M), cyan (C), and black (K).

The intermediate transfer belt 5 is in contact with all photosensitive drums 1 and rotates in a direction of an arrow B in FIG. 2. The intermediate transfer belt 5 is stretched over a plurality of supporting members (a driver roller 26, a secondary transfer opposing roller 27, and a driven roller 28). Four primary transfer rollers 8 (8Y, 8M, 8C, and 8K) as primary transfer means are arranged side by side on a side of an inner peripheral surface of the intermediate transfer belt 5 so as to oppose each photosensitive drum 1. In addition, a secondary transfer roller 9 as secondary transfer means is arranged at a position opposing the secondary transfer opposing roller 27 on a side of an outer peripheral surface of the intermediate transfer belt 5.

Image Forming Process

During image formation, first, the surface of the photosensitive drum 1 is uniformly charged by the charging roller 2. Next, due to laser light in accordance with image information emitted from the scanner unit 3, the charged surface of the photosensitive drum 1 is subjected to scanning exposure and an electrostatic latent image in accordance with the image information is formed on the photosensitive drum 1. The electrostatic latent image formed on the photosensitive drum 1 is then developed by the developing unit 4 as a toner image (a developer image). The toner image formed on the photosensitive drum 1 is transferred (primarily transferred) onto the intermediate transfer belt 5 by an action of the primary transfer roller 8.

For example, when forming a full-color image, the process described above is sequentially performed in the first to fourth image forming portions SY, SM, SC, and SK, and toner images of the respective colors are primarily transferred onto the intermediate transfer belt 5 by being sequentially superimposed on one another. Subsequently, the recording material 12 is transported to a secondary transfer portion in synchronization with a movement of the intermediate transfer belt 5. In addition, due to an action of the secondary transfer roller 9 in contact with the intermediate transfer belt 5 via the recording material 12, the four-color toner images on the intermediate transfer belt 5 are collectively secondarily transferred onto the recording material 12.

The recording material 12 onto which the toner images have been transferred is transported to a fixing apparatus 10 as fixing means. Heat and pressure are applied to the recording material 12 by the fixing apparatus 10 to fix the toner images onto the recording material 12. Subsequently, the recording material 12 on which the toner images have been fixed is discharged to outside of the machine.

Primary transfer residual toner that remains on the photosensitive drum 1 after the primary transfer process is removed by the cleaning blade 6. In addition, secondary transfer residual toner that remains on the intermediate transfer belt 5 after the secondary transfer process is removed by an intermediate transfer belt cleaning apparatus 11. The removed secondary transfer residual toner is discharged to a waste toner box (not shown) of the image forming apparatus 100.

The image forming apparatus 100 is also configured so as to be capable of forming a single-color or multi-color image using only a single or some (not all) desired image forming portions.

Process Cartridge

Figure 6A:
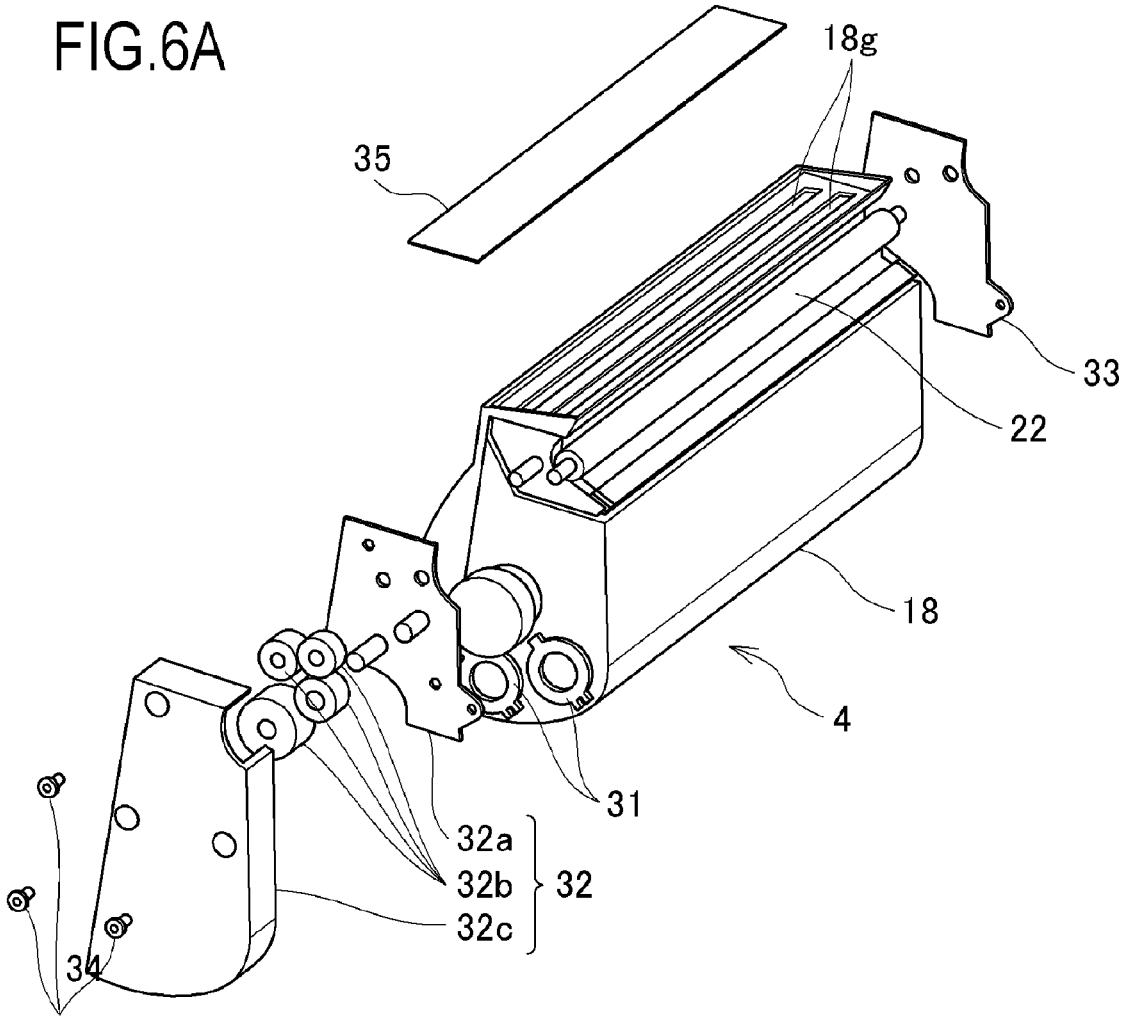
FIGS. 6A and 6B are an exploded view and a perspective view showing a configuration of the developer storage container according to the first embodiment.

An overall configuration of the process cartridge 7 to be mounted to the image forming apparatus 100 according to the present embodiment will now be described with reference to FIGS. 4, 6A, and 6B. FIG. 6A is an exploded view of the developing unit 4 and FIG. 6B is a perspective view of the developing unit 4.

As shown in FIG. 4, the photosensitive unit 13 includes a cleaning frame 14 as a frame that supports various elements inside the photosensitive unit 13. The photosensitive drum 1 is attached to the cleaning frame 14 via a bearing member so that the photosensitive drum 1 is rotatable in a direction of an arrow A. In addition, a charging roller bearing 15 is attached to the cleaning frame 14 along a line that passes through a center of rotation of the charging roller 2 and a center of rotation of the photosensitive drum 1 so as to be movable in a direction of an arrow C. The charging roller 2 is rotatably attached to the charging roller bearing 15. In addition, the charging roller bearing 15 is biased toward the photosensitive drum 1 by a charging roller pressure spring 16 as biasing means.

The cleaning blade 6 is integrally formed by an elastic member 6*a* for removing primary transfer residual toner that remains on the surface of the photosensitive drum 1 after primary transfer and a supporting member 6*b* for supporting the elastic member. The primary transfer residual toner having been removed from the surface of the photosensitive drum 1 by the cleaning blade 6 drops in a direction of gravity in a space formed by the cleaning blade 6 and the cleaning frame 14 and is stored in the waste toner storage portion 14*a*.

Figure 6B:
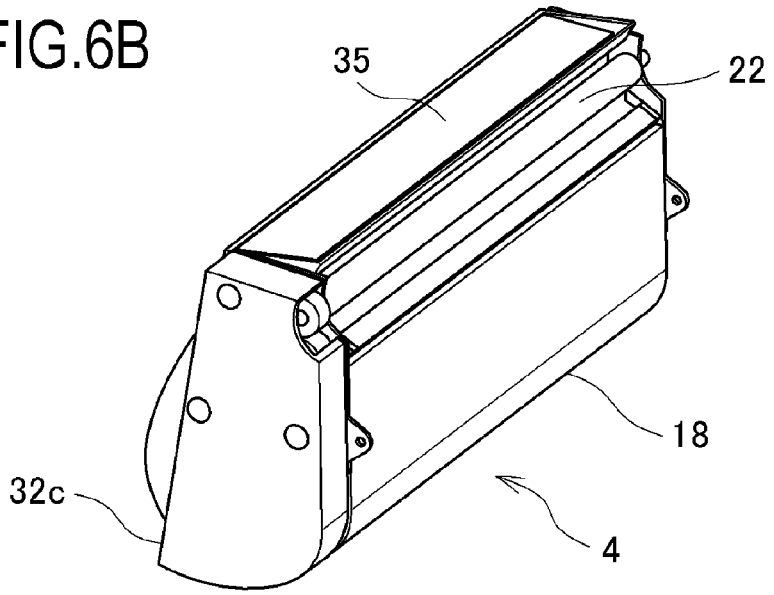

As shown in FIGS. 6A and 6B, the developing unit 4 includes a developing frame 18 which supports various elements inside the developing unit 4 and which is also a developer storage container. The developing unit 4 is provided with a developing roller 22 which comes into contact with the photosensitive drum 1 and rotates in a direction of an arrow D. The developing roller 22 is rotatably supported at both ends in a direction of a rotational axis thereof by the developing frame 18 via bearing units 32 and 33.

The developing unit 4 has a developer storage chamber (a storage chamber) 18*a* for storing toner, a developing chamber 18*b* in which the developing roller 22 is arranged, and an opening (an internal opening or a first opening) 18*c* which connects the developer storage chamber 18*a* and the developing chamber 18*b* each other. More specifically, the developing frame 18 has a partition portion (a partition wall) 18*m* which partitions the developer storage chamber 18*a* and the developing chamber 18*b* of the developing frame 18. The opening 18*c* is provided in the partition portion 18*m*. In addition, the developing frame 18 is provided with a developer opening (a second opening) for exposing a part of the developing roller 22 to outside of the developing frame 18. In the present embodiment, when the process cartridge 7 is in a posture when the developing unit 4 being used (when the process cartridge 7 is mounted to the image forming apparatus 100), the developing chamber 18*b* is positioned above the developer storage chamber 18*a*. A developer supplying member (a supplying roller) 20 which comes into contact with the developing roller 22 and rotates and a developer restricting member (a developing blade) 21 for restricting a toner layer of the developing roller 22 are arranged in the developing chamber 18*b*.

The developer storage chamber 18*a* of the developing frame 18 is provided with a stiffing member 23 for stirring stored toner T and transporting the toner to the developer supplying member 20 via the opening 18*c*. The stiffing member 23 has a rotating shaft 23*a* extending in a rotational axis direction of the stirring member 23 (a first direction) and a stirring sheet 23*b* which is a flexible sheet member having one end attached to the rotating shaft 23*a* and which stirs and transports toner. In other words, the stirring member 23 is configured so as to be rotatable around an axis extending in the rotational axis direction (a center of the rotating shaft 23*a*).

In the present embodiment, a longitudinal direction of the process cartridge 7 and the axial direction of the developing unit 4 are parallel to the rotational axis direction of the stirring member 23. In addition, the rotational axis directions of the developing roller 22, the supplying roller 20, and the photosensitive drum 1 are parallel to the rotational axis direction of the stirring member 23.

The stirring member 23 rotates in a direction of an arrow F in a state where a side of another end of the stirring sheet 23*b* which is a free end has come into contact with an inner wall surface of the developer storage chamber 18*a* and is deflected. The developer storage chamber 18*a* has a release position 18*e* at which the stirring sheet 23*b* is released from the deflected state. When passing the release position 18*e*, the stirring sheet 23*b* flips up toner present on the stirring sheet 23*b* due to a release force from the deflected state and transports the toner to the developer supplying member 20 inside the developing chamber 18*b* via the opening 18*c*. Specifically, the stirring sheet 23*b* is configured so as not to come into contact with the inner wall surface of the developer storage chamber 18*a* in at least a rotational phase from the release position 18*e* to a position opposing the opening 18*c* in a clockwise direction in FIG. 5 but capable of coming into contact with the inner wall surface of the developer storage chamber 18*a* in other rotational phases. In other words, due to a movement (a rotation) of the stirring member 23, a distance between the inner wall surface of the developing frame 18 and the stirring member 23 varies. In the present embodiment, the stirring sheet 23*b* comes into contact with the partition portion 18*m* after passing the release position 18*e*. In other words, the partition portion 18*m* restricts entry of the stirring member 23 (the stirring sheet 23*b*) to the developing chamber 18*b*.

Detailed Configuration of Developer Storage Container

Figure 5:
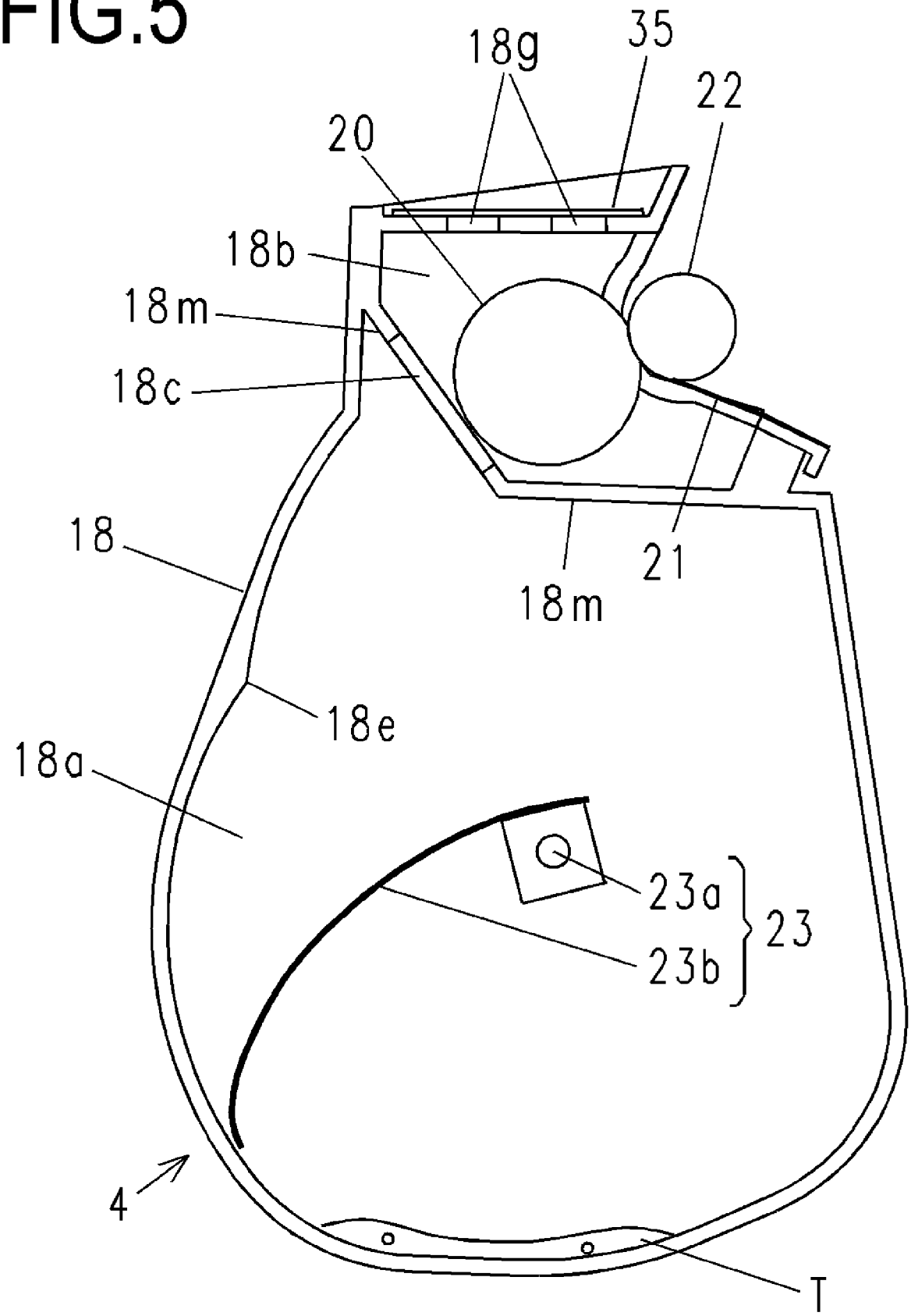
FIG. 5 is a sectional view showing a configuration of the developer storage container according to the first embodiment.

A detailed configuration of the developing frame 18 which is a developer storage container will be described with reference to FIGS. 5, 6A, and 6B. FIG. 5 is a schematic sectional view of the developing frame 18.

In the present embodiment, as shown in FIG. 5, in addition to the developer storage chamber 18*a*, the developing chamber 18*b*, the opening 18*c*, and the stirring member 23 described above, the developing frame 18 is provided with a filter 35 which reduces internal air pressure of the developing chamber 18*b* at a position opposing the opening 18*c* of the developing chamber 18*b*.

As shown in FIG. 6A, the developing roller 22 and the toner supplying roller 20 are supported via a first developing bearing unit 32 and a second developing bearing unit 33 with respect to the developing frame 18. The first developing bearing unit 32 is constituted by the developing roller 22, a developing bearing member 32*a* for supporting the toner supplying roller 20, a gear train 32*b* for transmitting drive to a stirring gear 30, and a side cover 32*c*. Two ventilation openings (vent holes) 18*g* which extend along an axial line of the developing roller 22 are arranged in parallel at positions opposing the opening 18*c* of the developing chamber 18*b* in the developing frame 18 in order to prevent internal pressure rise of the developing frame 18, and the filter 35 is bonded so as to cover the ventilation openings 18*g*. The ventilation openings 18*g* connect the inside of the developing chamber 18*b* and the outside of the developing frame 18. In addition, with respect to the axial direction of the stirring member 23, positions of the ventilation openings 18*g* and a position of the opening 18*c* overlap with each other. The filter 35 is formed by a material which restricts passage of toner but allows passage of air.

As shown in FIG. 6B, the side cover 32*c* is fixed to the developing frame 18 and the developing bearing member 32*a* by three screws 34 in a state where the side cover 32*c* covers a toner cap 31.

The toner cap 31 seals a toner filling port (not shown) which is provided at a longitudinal end portion of the developing frame 18 and which is used to fill the developer storage chamber 18*a* of the developing frame 18 with toner T during manufacture of the developing unit 4.

Remanufacturing Method of Process Cartridge

Figure 1:
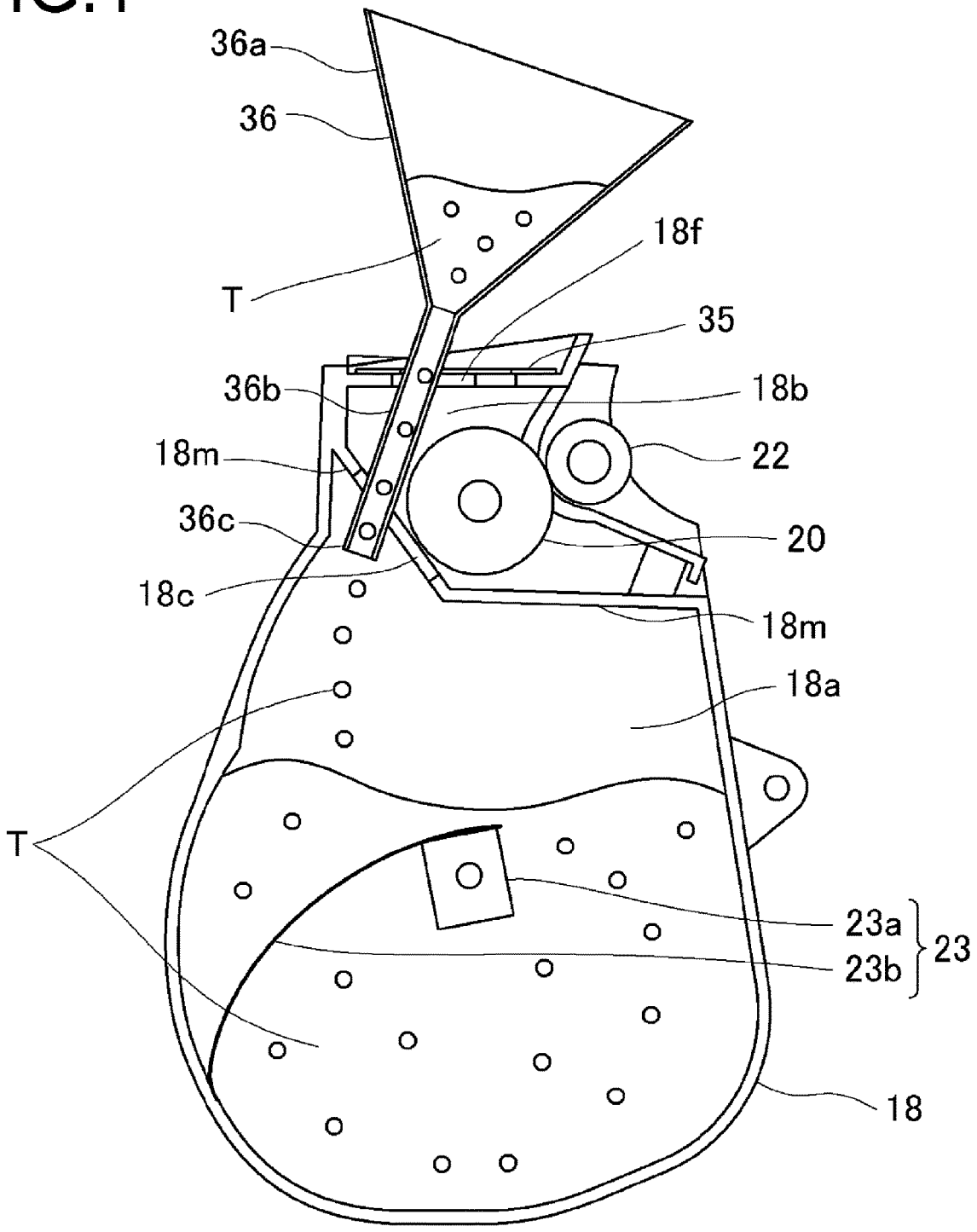
FIG. 1 is a sectional view showing a refilling process in remanufacturing of a developer storage container according to a first embodiment.

A remanufacturing method of the process cartridge 7 will be described in detail with reference to FIGS. 1 and 5 to 12B. FIG. 1 is a schematic sectional view of the developing frame 18 in a process of refilling toner. FIG. 5 is a schematic sectional view of the developing frame 18 prior to refilling toner.

Figure 7A:
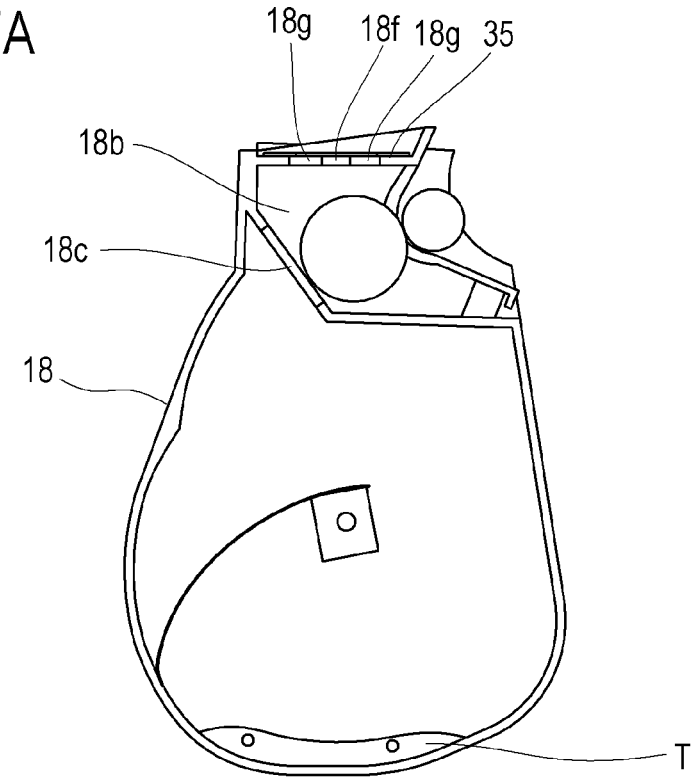
FIGS. 7A and 7B are explanatory diagrams of a communicating process in a remanufacturing method of a cartridge according to the first embodiment.
Figure 7B:
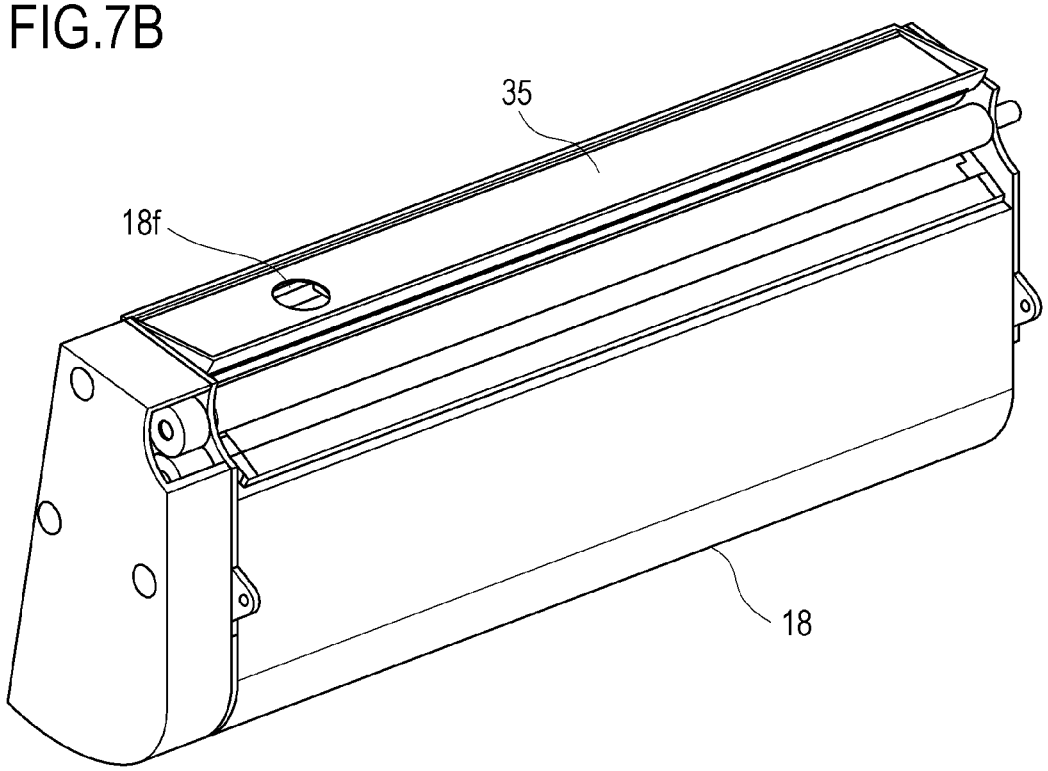

FIG. 7A is a sectional view of the developing frame 18 after boring a hole, and FIG. 7B is a perspective view of the developing frame 18 in an example of a communicating process of the developing frame 18.

Figure 8A:
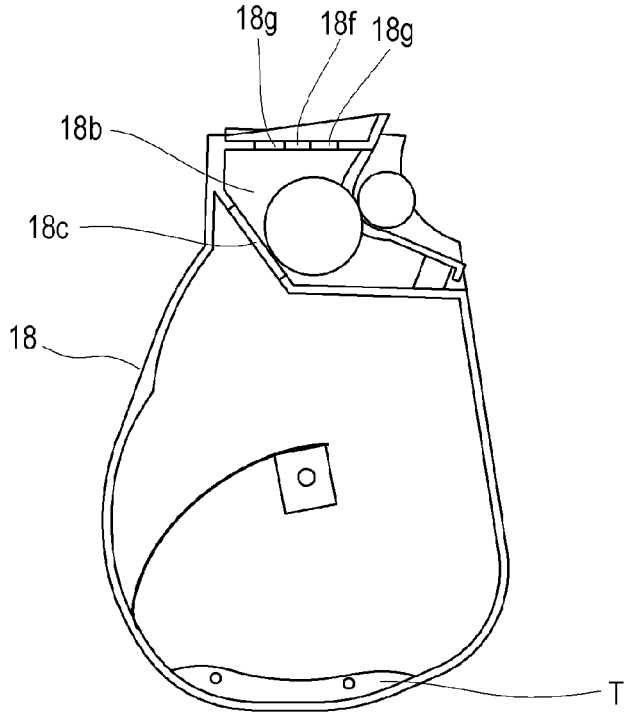
FIGS. 8A and 8B are explanatory diagrams of the communicating process in the remanufacturing method of a cartridge according to the first embodiment.
Figure 8B:
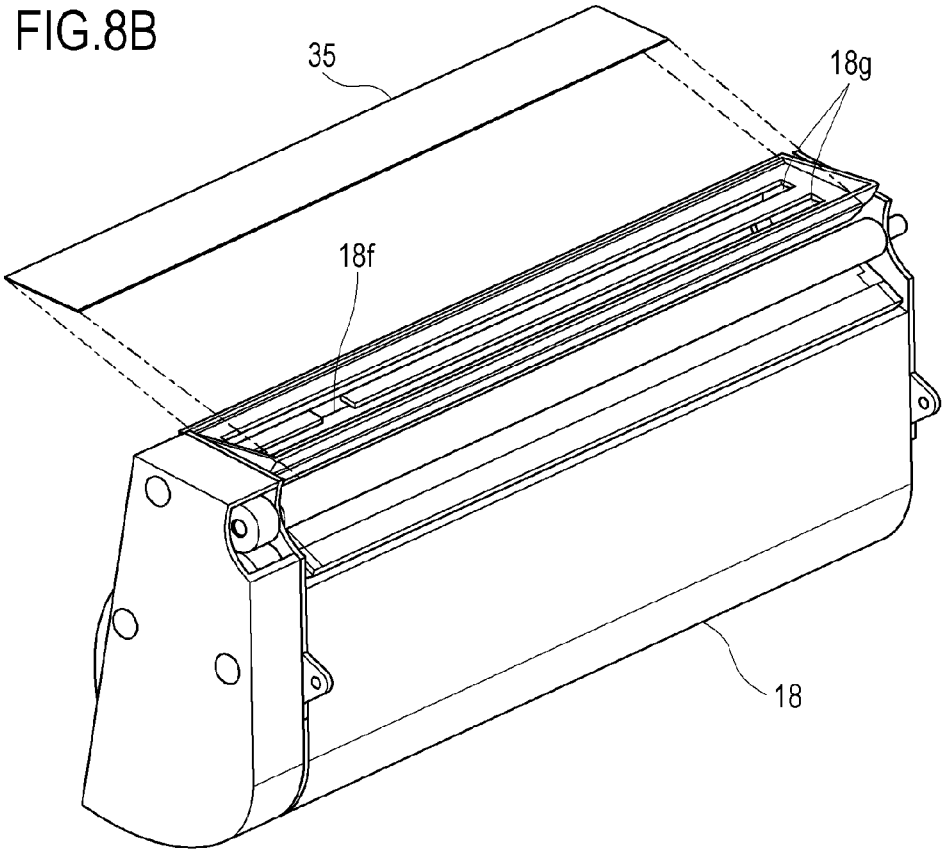

FIG. 8A is a sectional view of the developing frame 18 after boring a hole, and FIG. 8B is a perspective view of the developing frame 18 in an example of the communicating process of the developing frame 18.

Figure 9:
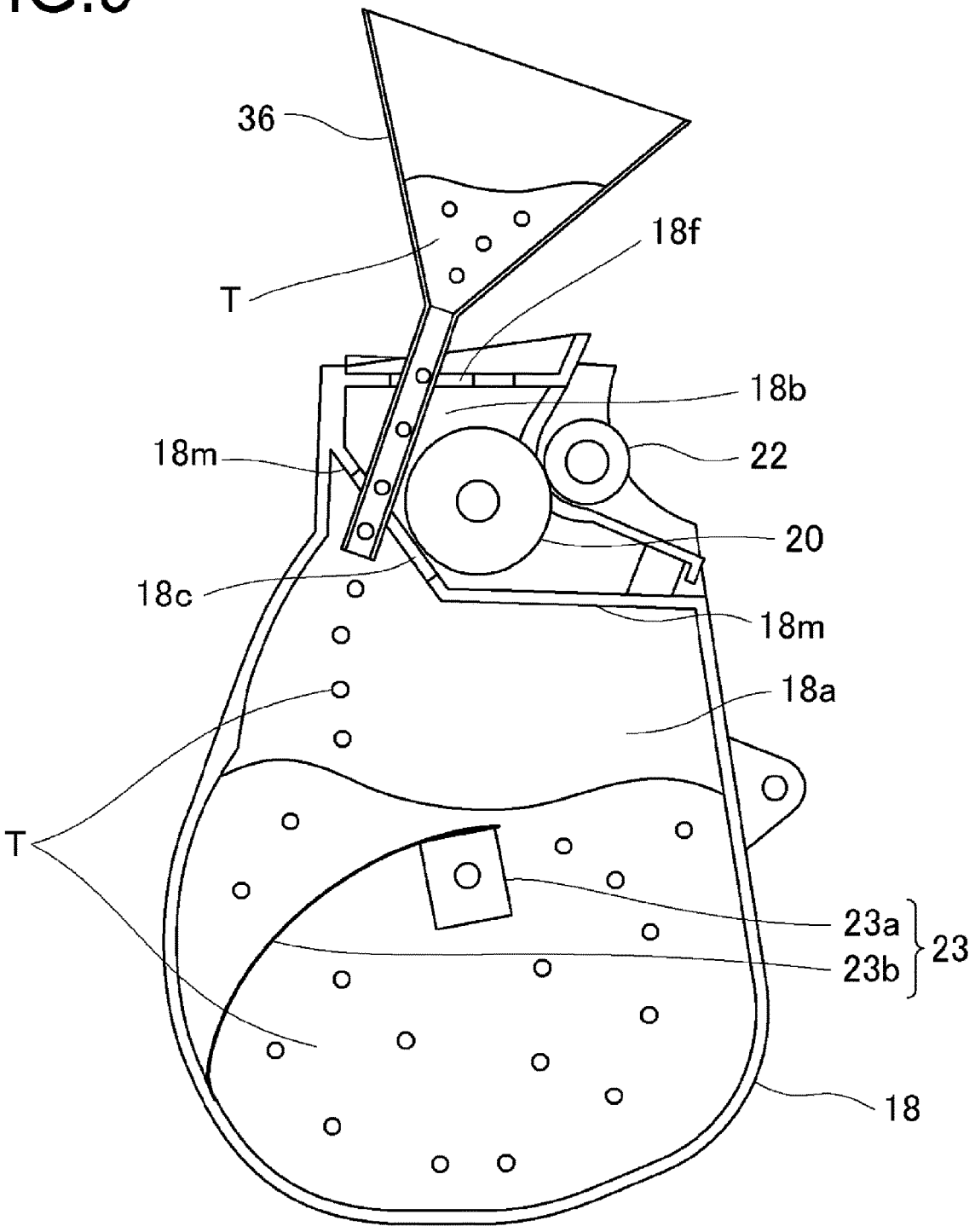
FIG. 9 is an explanatory diagram of a refilling process in the remanufacturing method of a cartridge according to the first embodiment.

FIG. 9 is a sectional view of the developing frame 18 in an example of a process of refilling toner.

Figure 10A:
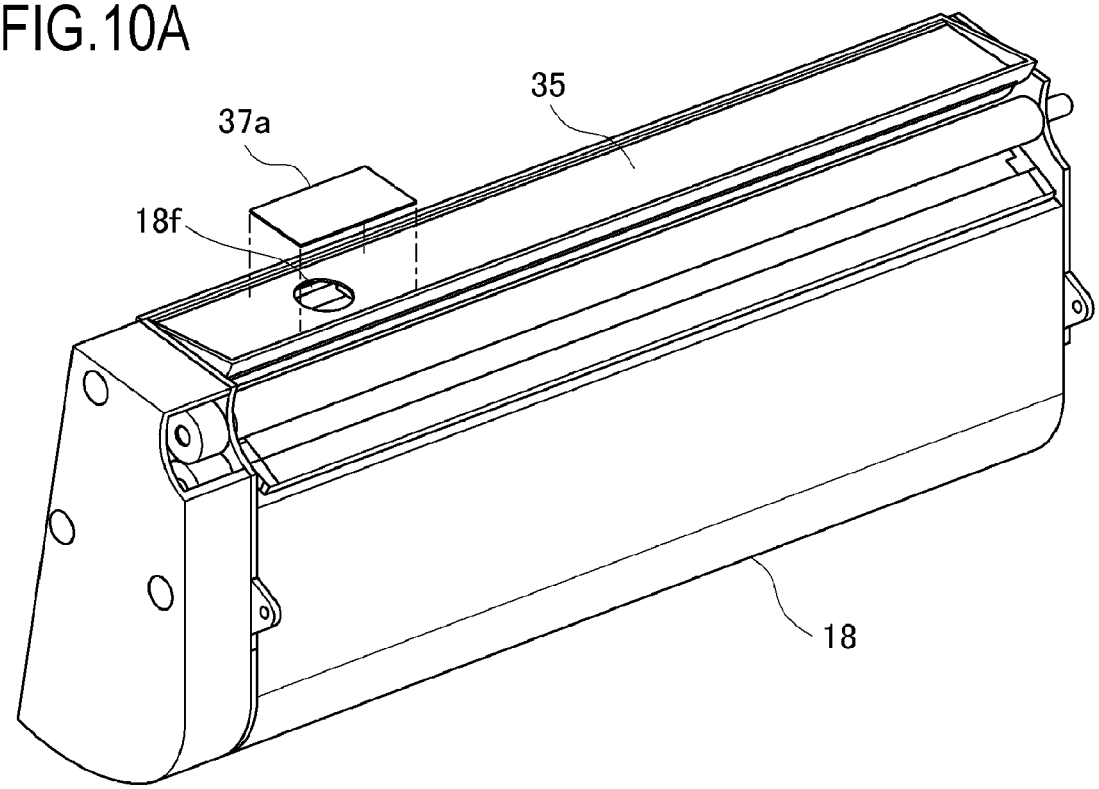
FIGS. 10A and 10B are explanatory diagrams of a sealing process in the remanufacturing method of a cartridge according to the first embodiment.
Figure 10B:
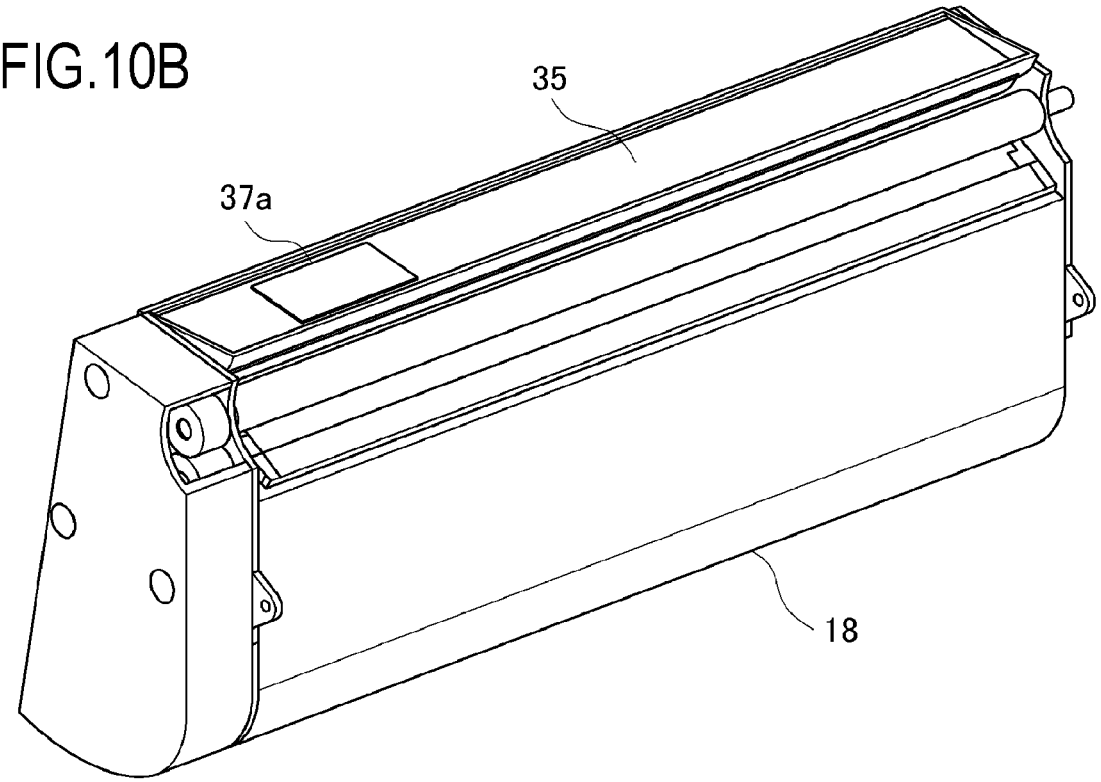

FIG. 10A is an exploded view of an example of a sealing process for sealing the communication hole 18*f* of the developing frame 18, and FIG. 10B is a perspective view of an example in which the communication hole 18*f* of the developing frame 18 has been sealed.

Figure 11A:
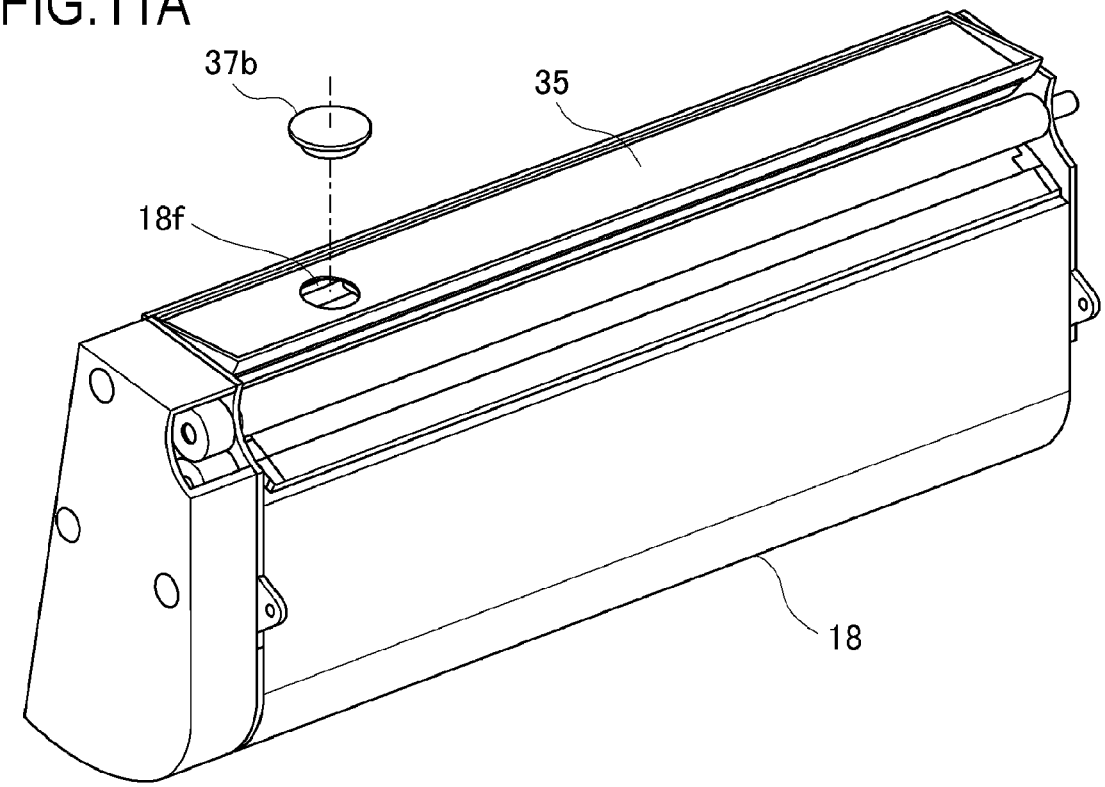
FIGS. 11A and 11B are explanatory diagrams of the sealing process in the remanufacturing method of a cartridge according to the first embodiment.
Figure 11B:
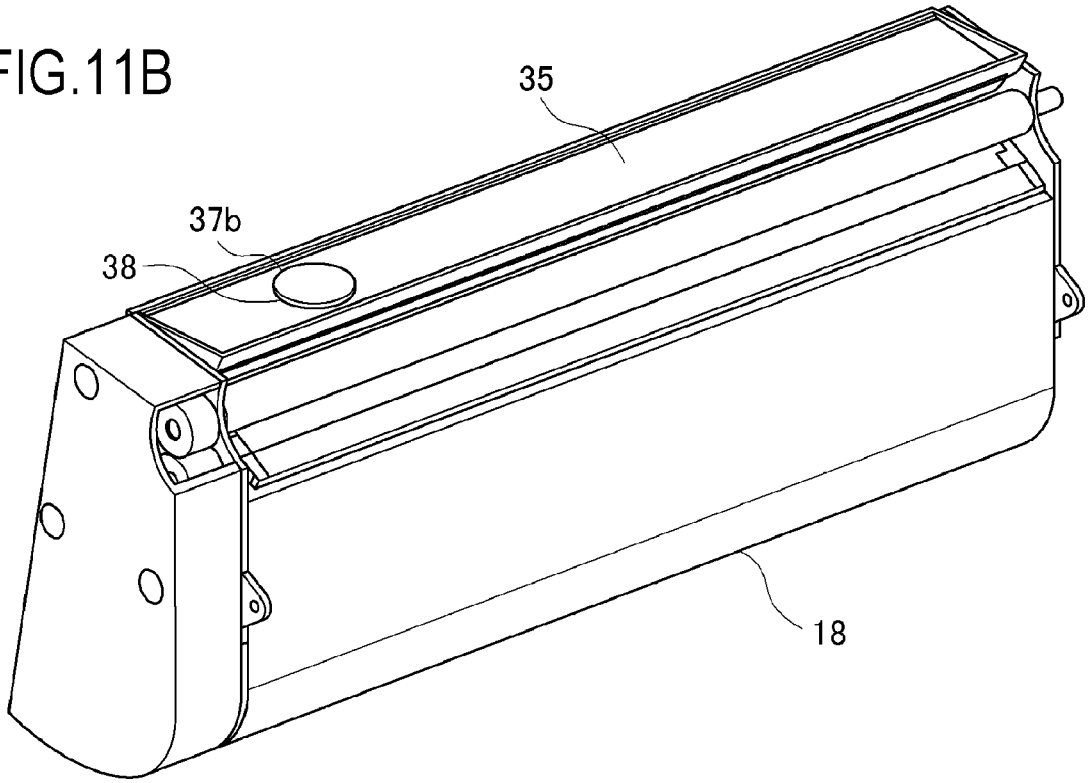

FIG. 11A is an exploded view of an example of the sealing process for sealing the communication hole 18*f* of the developing frame 18, and FIG. 11B is a perspective view of an example in which the communication hole 18*f* of the developing frame 18 has been sealed.

Figure 12A:
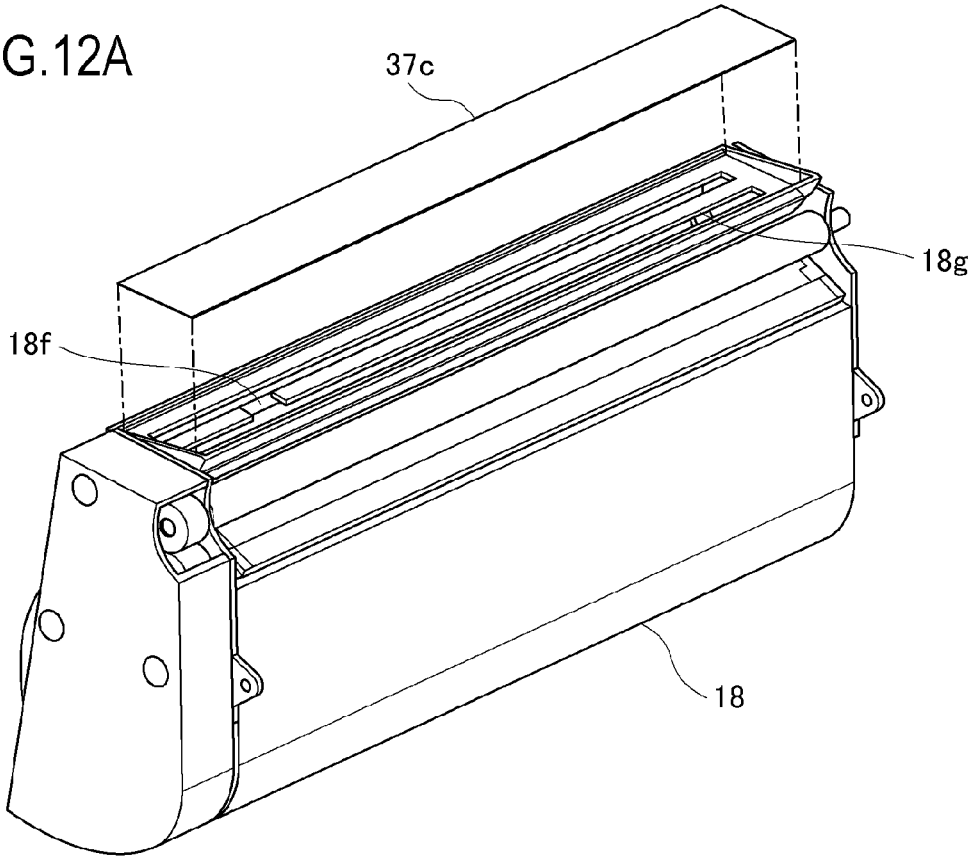
FIGS. 12A and 12B are explanatory diagrams of the sealing process in the remanufacturing method of a cartridge according to the first embodiment.
Figure 12B:
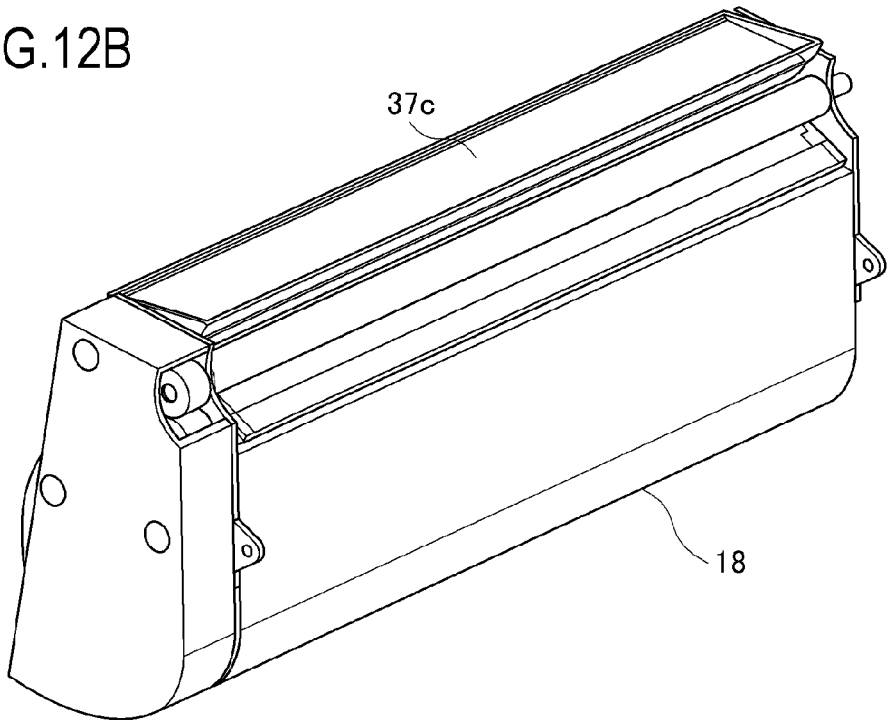

FIG. 12A is an exploded view of an example of the sealing process for sealing the communication hole 18*f* of the developing frame 18, and FIG. 12B is a perspective view of an example in which the communication hole 18*f* of the developing frame 18 has been sealed.

The developing unit 4 according to the present embodiment may sometimes be remanufactured independently (separated from the photosensitive unit 13) or may sometimes be remanufactured in an integrated state with the photosensitive unit 13 (in other words, as the process cartridge 7). In other words, cartridges in the remanufacturing method of a cartridge according to the present invention may sometimes be the developing unit 4 (a developing apparatus) having been independently made into a cartridge or may sometimes be the process cartridge 7 as described in the present embodiment.

The remanufacturing method of a cartridge according to the present embodiment generally includes the following three steps:

Step 1: communicating process of the developing frame 18,

Step 2: toner refilling process, and

Step 3: sealing process for sealing a hole of the developing frame 18.

It should be noted that the remanufacturing method according to the present embodiment includes a preparing step of preparing a cartridge (the developing unit 4 or the process cartridge 7) to be a material before performing the steps 1 to 3 described above. As the developing unit 4 or the process cartridge 7 to be a material, for example, a used developing unit 4 or a used process cartridge 7 in a state where toner has been consumed by performing image forming operations is used. In other words, the remanufacturing method according to the present embodiment is a method of remanufacturing a new developing unit (a second developing apparatus) from the developing unit 4 (a first developing apparatus) to be a material. In still other words, the remanufacturing method according to the present embodiment is a method of remanufacturing a new process cartridge (a second process cartridge) from the process cartridge 7 (a first process cartridge) to be a material.

Hereinafter, each step will be described in sequence.

Step 1: Communicating Process of Developing Frame 18

The communicating process of the developing frame 18 will be described with reference to FIGS. 7A, 7B, 8A, and 8B.

As shown in FIG. 7A, a communication hole (a third opening) 18*f* for communicating the developing chamber 18*b* and the outside of the developing frame 18 is bored at a position opposing the opening 18*c* of the developing chamber 18*b* in the developing frame 18. The communication hole 18*f* is bored using an ultrasonic cutter, laser machining, or the like. In other words, a part of the developing frame 18 is removed to form the communication hole 18*f* on the developing frame 18. Due to the communication hole 18*f*, the developer storage chamber 18*a* communicates with the outside of the developing frame 18 via the opening 18*c*, the developing chamber 18*b*, and the communication hole 18*f*. The communication hole 18*f* is formed so as to open on a wall surface in an upper part of the developing chamber 18*b* when the process cartridge 7 is in the posture when the developing unit 4 being used.

A shape and a size of the communication hole 18*f* and a position at which the communication hole 18*f* is provided are preferably a shape, a size, and a position which enable a funnel 36 (to be described later) to be inserted so that a leg portion of the funnel 36 reaches the developer storage chamber 18*a*. In addition, the shape and the size of the communication hole 18*f* are preferably a shape and a size which enable the communication hole 18*f* to be closed by a sticker member 37*a* or a cap member 37*b* (to be described later).

In the example of the communicating process shown in FIGS. 7A and 7B, the communication hole 18*f* is formed so as to penetrate the filter 35 and an affixing portion of the filter 35 in the developing frame 18. In other words, a through-hole is also formed in the filter 35, and the communication hole 18*f* is formed by the through-hole of the filter 35 and an expanded ventilation opening 18*g* (to be described later). In the developing frame 18 according to the present embodiment, since a size of the ventilation opening 18*g* provided in the affixing portion of the filter 35 is not large enough to enable the leg portion of the funnel 36 to be inserted thereinto, the communication hole 18*f* of a desired size is formed by also partially cutting away a periphery of the ventilation opening 18*g*. In other words, it can be argued that the communicating process includes a process of expanding a size of the ventilation opening 18*g* as the communication hole originally provided in the developing frame 18 to a size that enables the leg portion of the funnel 36 to be inserted thereinto. In the case of a configuration in which the ventilation opening 18*g* has a sufficient size, a through-hole may only be formed in the filter 35 and the communication hole 18*f* may be formed by the through-hole of the filter 35 and the ventilation opening 18*g*. Using the ventilation opening 18*g* enables generation of shavings to be suppressed as compared to a case where a new communication hole 18*f* is formed in the developing frame 18.

Alternatively, as in the example of the communicating process shown in FIG. 8A, at least a part of the filter 35 may be peeled away from the developing frame 18 to form the communication hole 18*f*. In other words, a removing process of peeling the filter 35 away from the developing frame 18 is first performed and, subsequently, a process of boring the communication hole 18*f* with a desired size in the developing frame 18 is performed. A peripheral portion of the ventilation opening 18*g* is partially cut away when forming the communication hole 18*f* in a similar manner to the example shown in FIGS. 7A and 7B described above. In the case of a configuration in which the ventilation opening 18*g* has a sufficient size, the communicating process may be completed by only an action of peeling the filter 35 away from the developing frame 18. In other words, in the communicating process, the ventilation opening 18*g* may be used as the communication hole 18*f* without removing a part of the developing frame 18. Accordingly, work for removing a part of the developing frame 18 can be omitted and generation of shavings can be suppressed. It should be noted that, as shown in FIG. 8B, the communication hole 18*f* may be formed by connecting a plurality of ventilation openings 18*g*. Expanding the ventilation opening 18*g* or connecting a plurality of ventilation openings 18*g* can also improve degassing performance of the ventilation opening 18*g*. Even in this case, it can be argued that the ventilation opening 18*g* is being expanded.

The communicating process of the developing frame 18 is not limited to the methods described above. Other methods can be appropriately adopted as long as a communication hole which establishes communication between the developer storage chamber 18*a* and the outside of the developing frame 18 and which enables an introduction path of refill toner to be secured during toner refill (to be described later) can be formed in the developing frame 18.

Step 2: Toner Refilling Process

The toner refilling process of filling the developing frame 18 with new toner will be described with reference to FIGS. 1 and 9.

FIG. 1 is a schematic sectional view showing a situation where toner refill is performed with respect to the developing frame 18 in which the communication hole 18*f* has been formed so as to penetrate the filter 35 and the affixing portion of the filter 35 in the developing frame 18 by the communicating process shown in FIGS. 7A and 7B. Toner refill to the developer storage chamber 18*a* is performed by inserting the funnel 36 into the communication hole 18*f* and pouring toner T into the funnel 36 from a toner bottle (not shown) or the like. The funnel 36 has a conical portion 36*a* for receiving the toner T poured from the toner bottle and a tubular leg portion 36*b* which extends from a small-diameter leading end portion of the conical portion 36*a*, and the funnel 36 is inserted into the developing frame 18 to a position where an opening leading end portion 36*c* of the leg portion 36*b* reaches the developer storage chamber 18*a*. In the present embodiment, with respect to the axial direction of the stirring member 23, positions of the ventilation openings 18*g* and the position of the opening 18*c* overlap with each other. Therefore, the opening leading end portion 36*c* of the leg portion 36*b* can be readily inserted to a position where the opening leading end portion 36*c* reaches the developer storage chamber 18*a*. Accordingly, a refill introduction path of the toner T is formed which reaches the developer storage chamber 18*a* from the outside of the developing frame 18 via the communication hole 18*f*, the developing chamber 18*b*, and the opening 18*c*. While the toner T can also be refilled from other portions, filling the developer storage chamber 18*a* with the toner T from the communication hole 18*f* which is proximal to the developer storage chamber 18*a* makes it easier for the toner to enter the developer storage chamber 18*a*.

FIG. 9 is a schematic sectional view showing a situation where toner refill is performed with respect to the developing frame 18 in which the communication hole 18*f* has been formed by peeling away the filter 35 according to the communicating process shown in FIGS. 8A and 8B. As shown in FIG. 9, toner refill to the developer storage chamber 18*a* is performed by peeling away the filter 35, inserting the funnel 36 into the formed communication hole 18*f*, and pouring toner into the funnel 36 from a toner bottle (not shown) or the like.

It should be noted that toner refill is not limited to methods using the funnel 36 described above as a tool for refilling the developer storage chamber 18*a* with the toner T. For example, a method may be adopted in which refill is performed by inserting a tubular portion of a dispenser or a hose-like tubular member being connected to a toner supply source.

Refill need not necessary involve directly filling the developer storage chamber 18*a* with toner. In other words, the developing chamber 18*b* may be filled with toner from the outside of the developing frame 18 via the communication hole 18*f*. In doing so, the stirring member 23 is preferably moved so as not to cover the opening 18*c*. Accordingly, the developer storage chamber 18*a* can be filled with the toner having filled the developing chamber 18*b* through the opening 18*c*.

Step 3: Sealing Process for Sealing Hole of Developing Frame 18

The sealing process for sealing the communication hole 18*f* of the developing frame 18 will be described with reference to FIGS. 10A, 10B, 11A, 11B, 12A, and 12B.

In the sealing process according to the present embodiment, the communication hole 18*f* can be sealed using various sealing members 37.

As shown in FIG. 10A, the sticker member 37*a* may be used as the sealing member 37. An adhesive surface of the sticker member 37*a* is attached to the filter 35 at a position where the communication hole 18*f* is to be sealed to provide a seal so that toner T does not leak from the communication hole 18*f*.

Alternatively, as shown in FIG. 11A, the cap member 37*b* may be used as the sealing member 37. After attaching the cap member 37*b* to the filter 35 so as to close the communication hole 18*f*, an adhesive member 38 is injected to bonding surfaces of the cap member 37*b* and the filter 35 or the adhesive member 38 is applied to the bonding surfaces in advance, and the cap member 37*b* and the filter 35 are bonded to each other. Bonding methods are not limited and a pressure sensitive adhesive or a silicone bond may be used.

Alternatively, as shown in FIG. 12A, the filter 35 may be replaced with a new filter 37*c* and the new filter 37*c* may be attached to the developing frame 18 so as to cover the communication hole 18*f* (the ventilation opening 18*g*). In doing so, the filter 35 may be reused. In the communicating process shown in FIGS. 8A and 8B, the filter 35 is peeled away, the communication hole 18*f* is formed and, after refill, the new filter 37*c* is attached and the new filter 37*c* and the developing frame 18 are bonded to each other. Bonding methods are not limited and heat-welding or a double-sided tape may be used.

Advantages of Present Embodiment

As described above, with steps 1 to 3 described above, a remanufacturing method of a cartridge which prevents work from being disturbed by a stiffing member of the cartridge can be provided.

Specifically, the communication hole 18*f* is formed so as to open to the developing chamber 18*b* which is partitioned by the partition portion 18*m* with respect to the developer storage chamber 18*a* in which the stirring member 23 is stored. Accordingly, the stirring member 23 is prevented from closing the communication hole 18*f*. In other words, work for filling the inside of the developing frame 18 with toner from the outside of the developing frame 18 is not impeded by the stirring member 23. In addition, even in cases where a part of the developing frame 18 is removed in the process of forming the communication hole 18*f* or expanding the communication hole 18*f* (the ventilation opening 18*g*), the stirring member 23 is prevented from being damaged. Therefore, there is no need to move the stirring member 23 in order to prevent damage to the stirring member 23. In other words, work for removing a part of the developing frame 18 is not impeded by the stirring member 23.

In addition, with the remanufacturing method of a cartridge according to the present embodiment, the communication hole 18*f* (the ventilation opening 18*g*) opens in a direction (a second direction) that intersects with a direction of the rotational axis of the stirring member 23. Therefore, an insertion direction of the funnel 36 is a direction that approximately matches a direction in which the stirring sheet 23*b* is likely to exhibit flexibility. While the funnel 36 and the stirring sheet 23*b* preferably do not come into contact with each other, even when the funnel 36 and the stirring sheet 23*b* come into contact with each other, since the contact occurs in a direction in which the stirring sheet 23*b* is likely to exhibit flexibility, the stirring sheet 23*b* is less likely to be damaged. Furthermore, even when the stirring sheet 23*b* stops at a position where the stirring sheet 23*b* closes the opening 18*c* between the developer storage chamber 18*a* and the developing chamber 18*b*, the leg portion 36*b* of the funnel 36 can be inserted to the developer storage chamber 18*a* by utilizing the flexibility of the stirring sheet 23*b* and causing the stirring sheet 23*b* to deflect (by pushing back the stirring sheet 23*b*). As described above, since the stirring sheet 23*b* is in a released state where the stirring sheet 23*b* is not in contact with the inner wall surface of the developer storage chamber 18*a* at the position where the stirring sheet 23*b* closes the opening 18*c*, it is not difficult to push the leg portion 36*b* of the funnel 36 into the communication hole 18*f* and cause the stirring sheet 23*b* to deform so as not to damage the stirring sheet 23*b*.

Second Embodiment

A remanufacturing method of the process cartridge 7 according to a second embodiment will now be described in detail with reference to FIG. 13. In the second embodiment, descriptions of matters in common with those of the first embodiment will be generally omitted.

Figure 13:
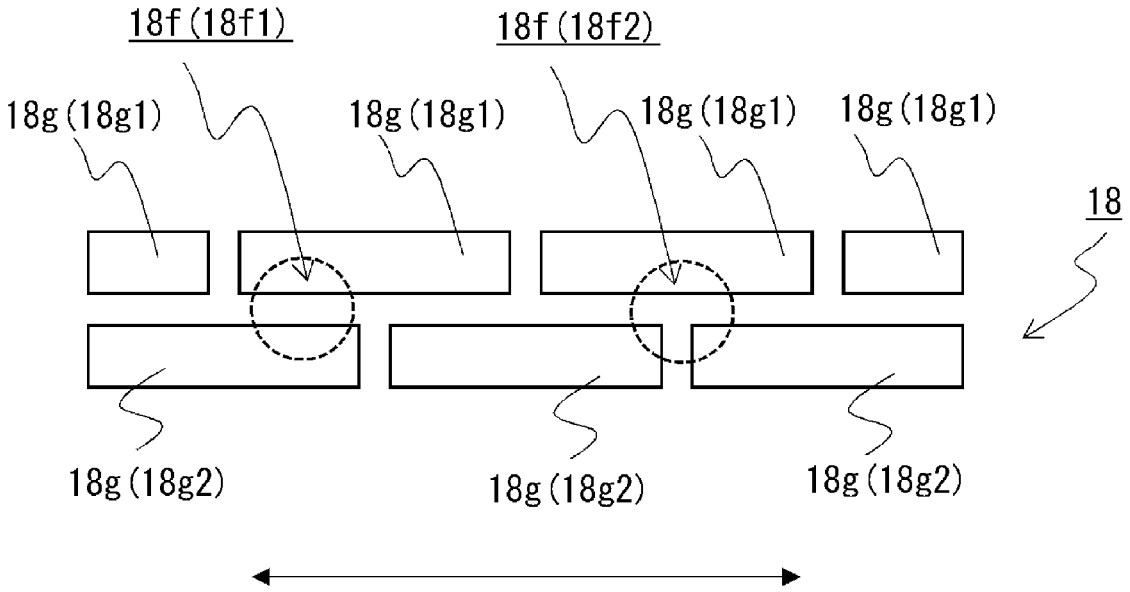
FIG. 13 is an explanatory diagram of a communicating process according to a second embodiment.

FIG. 13 is an explanatory diagram of a communicating process according to the second embodiment. The second embodiment differs from the first embodiment in an arrangement of the ventilation opening 18*g* and an arrangement of the communication hole 18*f*.

An arrow in FIG. 13 indicates a longitudinal direction of the process cartridge 7 (a rotational axis direction of the developing roller 22). As shown in FIG. 13, the developing frame 18 according to the second embodiment includes a plurality of ventilation openings 18*g*. It should be noted that the ventilation openings 18*g* according to the second embodiment are arranged at positions opposing the opening 18*c* in a similar manner to the first embodiment (refer to FIGS. 5, 6A, and 6B). In addition, the ventilation openings 18*g* are covered by the filter 35 in a similar manner to the first embodiment.

The plurality of the ventilation openings 18*g* include a plurality of first ventilation openings 18*g*1 and a plurality of second ventilation openings 18*g*2. In a direction perpendicular to the rotational axis direction of the developing roller 22, positions of the first ventilation openings 18*g*1 and positions of the second ventilation openings 18*g*2 differ from and do not overlap with each other. In the rotational axis direction of the developing roller 22, the positions of the first ventilation openings 18*g*1 and the positions of the second ventilation openings 18*g*2 differ from each other. However, the positions of at least a part of the first ventilation openings 18*g*1 and the positions of at least a part of the second ventilation openings 18*g*2 overlap with each other.

The communication hole 18*f* is formed so as to connect the first ventilation openings 18*g*1 and the second ventilation openings 18*g*2. In doing so, the communication hole 18*f* can be formed so as to connect one first ventilation opening 18*g*1 and one second ventilation opening 18*g*2 (18*f*1). In addition, the communication hole 18*f* can also be formed so as to connect one first ventilation opening 18*g*1 and a plurality of the second ventilation openings 18*g*2 (18*f*2). The communication hole 18*f* can also be formed so as to connect a plurality of the first ventilation openings 18*g*1 and a plurality of the second ventilation openings 18*g*2. Furthermore, a plurality of communication holes 18*f* can be formed in the developing frame 18. For example, a communication hole denoted by 18*f*1 and a communication hole denoted by 18*f*2 can be formed in the developing frame 18. Alternatively, any one of a communication hole denoted by 18*f*1 and a communication hole denoted by 18*f*2 can be formed in the developing frame 18. In doing so, in order to form the communication hole 18*f*, a part of the developing frame 18 positioned between the respective ventilation openings 18*g* is removed.

According to the arrangement of the ventilation openings 18*g* (the plurality of first ventilation openings 18*g*1 and the plurality of second ventilation openings 18*g*2) described in the present embodiment, the communication hole 18*f* can be readily formed. In addition, by increasing the number of ventilation openings 18*g* which become connected by forming the communication hole 18*f*, the communication hole 18*f* can be readily expanded. Accordingly, the degassing performance of the ventilation openings 18*g* can also be improved.

Since the refilling process of toner and the sealing process of sealing the communication hole 18*f* are the same as those of the first embodiment, descriptions thereof will be omitted. In other words, in the same manner as in the first embodiment, the communication hole 18*f* (the ventilation openings 18*g*) can be sealed by a sealing member such as the filter 35, the new filter 37*c*, or the cap member 37*b*.

According to the present invention, a cartridge can be remanufactured while preventing work from being disturbed by a stirring member of the cartridge.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-160408, filed Aug. 29, 2018, and Japanese Patent Application No. 2019-142871, filed Aug. 2, 2019, which are hereby incorporated by reference herein in their entirety.

What is claimed is:

1. A remanufacturing method for remanufacturing a developing apparatus, the developing apparatus including:

a frame having a storage chamber for storing developer, a developing chamber in which a developer bearing member for bearing the developer is arranged, and a partition portion that partitions the storage chamber and the developing chamber, the frame being provided with an opening in the partition portion such that the storage chamber and the developing chamber are connected to each other, and the frame provided with a ventilation opening that connects outside of the frame and the developing chamber to each other;

a filter that is attached to the frame so as to cover the ventilation opening; and a stirring member for stirring the developer, the stirring member being arranged in the storage chamber so as to be capable of coming into contact with a wall surface of the frame that forms the storage chamber, the remanufacturing method comprising:

a communicating step of cutting a part of the frame to form a communication hole such that outside of the frame and the developing chamber are connected to each other;

a refilling step of refilling an inside of the frame with developer via the communication hole; and a sealing step of sealing the communication hole.

2. The remanufacturing method according to claim 1, wherein the communication hole is arranged at a position opposing the opening.

3. The remanufacturing method according to claim 1, wherein the partition portion is configured to restrict entry of the stirring member into the developing chamber.

4. The remanufacturing method according to claim 1, wherein in the refilling step, the storage chamber is filled with the developer via the communication hole and the opening.

5. The remanufacturing method according to claim 1, wherein the stirring member has a rotating shaft and a sheet member, with one end of the sheet member being fixed to the rotating shaft and another end being capable of coming into contact with the wall surface.

6. The remanufacturing method according to claim 1, further comprising a step of exposing the ventilation opening to outside of the frame by peeling away at least a part of the filter from the frame.

7. The remanufacturing method according to claim 6, wherein in the sealing step, the filter is that peeled away from the frame or a new filter is attached to the frame so as to cover the ventilation opening.

8. The remanufacturing method according to claim 1, wherein the communicating step includes a step of forming a through-hole in the filter, and the communication hole includes the ventilation opening and the through-hole.

9. The remanufacturing method according to claim 8, wherein in the sealing step, a sealing member for closing the through-hole is bonded to the filter.

10. The remanufacturing method according to claim 1, wherein the communicating step includes a step of expanding a size of the ventilation opening.

11. The remanufacturing method according to claim 10, wherein the frame is provided with a plurality of ventilation openings, and the communicating step includes a step of connecting the plurality of ventilation openings.

12. The remanufacturing method according to claim 1, wherein when the developing apparatus is in a posture of being used, the developing chamber is positioned above the storage chamber and the communication hole is positioned on a wall surface in an upper part of the developing chamber.

13. A cartridge that is attachable to and detachable from an image forming apparatus, the cartridge comprising:

a developing apparatus remanufactured by the remanufacturing method according to claim 1; and a restricting member for restricting the developer borne by the developer bearing member.

14. A remanufacturing method for remanufacturing a developing apparatus, the developing apparatus including:

a frame having a storage chamber for storing developer, a developing chamber in which a developer bearing member for bearing the developer is arranged, and a partition portion that partitions the storage chamber and the developing chamber, the frame being provided with an opening in the partition portion such that the storage chamber and the developing chamber are connected to each other, and the frame provided with a ventilation opening that connects outside of the frame and the developing chamber to each other;

a filter that is attached to the frame so as to cover the ventilation opening; and a stirring member for stirring the developer, the stirring member being arranged in the storage chamber so as to be capable of coming into contact with a wall surface of the frame that forms the storage chamber, the remanufacturing method comprising:

a communicating step of forming a communication hole that connects outside of the frame and the developing chamber to each other by peeling away at least a part of the filter from the frame;

a refilling step of refilling an inside of the frame with developer; and a sealing step of sealing the communication hole.

15. The remanufacturing method according to claim 14, wherein the communication hole is arranged at a position opposing the opening.

16. The remanufacturing method according to claim 14, wherein the partition portion is configured so as to restrict entry of the stirring member into the developing chamber.

17. The remanufacturing method according to claim 14, wherein in the refilling step, the storage chamber is filled with the developer via the communication hole and the opening.

18. The remanufacturing method according to claim 14, wherein the stirring member has a rotating shaft and a sheet member, with one end of the sheet member being fixed to the rotating shaft and another end being capable of coming into contact with the wall surface.

19. The remanufacturing method according to claim 14, wherein in the sealing step, the filter that is peeled away from the frame or a new filter is attached to the frame so as to cover the ventilation opening.

20. The remanufacturing method according to claim 14, wherein the communicating step includes a step of forming a through-hole in the filter, and the communication hole includes the ventilation opening and the through-hole.

21. The remanufacturing method according to claim 20, wherein in the sealing step, a sealing member for closing the through-hole is bonded to the filter.

22. The remanufacturing method according to claim 14, wherein the communicating step includes a step of expanding a size of the ventilation opening.

23. The remanufacturing method according to claim 14, wherein the frame is provided with a plurality of ventilation openings, and the communicating step includes a step of connecting the plurality of ventilation openings.

24. A cartridge that is attachable to and detachable from an image forming apparatus, the cartridge comprising:

a developing apparatus remanufactured by the remanufacturing method according to claim 14; and a restricting member for restricting the developer borne by the developer bearing member.

* * * * *